US005777258A

United States Patent [19]

Soon

[11] Patent Number: 5,777,258

[45] Date of Patent: Jul. 7, 1998

[54] FIREARM BARREL CLEANING CARTRIDGE

[76] Inventor: Min Tet Soon, P.O. Box 10341, Sabah, Malaysia, 88803

[21] Appl. No.: 723,981

[22] Filed: Sep. 3, 1996

[51] Int. Cl.[6] ..... F42B 3/24

[52] U.S. Cl. ..... 102/442; 102/532; 42/95

[58] Field of Search ..... 102/430, 435, 102/442, 502, 511, 529, 532; 42/95

[56] References Cited

U.S. PATENT DOCUMENTS

| | | | |
|---|---|---|---|
| 938,836 | 11/1909 | Fessenden | 102/442 |
| 1,189,011 | 6/1916 | Smith | 102/511 |
| 3,058,420 | 10/1962 | Tanner et al. | 102/532 |
| 3,476,047 | 11/1969 | Davis | 102/442 |
| 3,740,883 | 6/1973 | Kyle | 102/442 |
| 4,328,632 | 5/1982 | Beers | 102/442 |
| 5,151,557 | 9/1992 | Bracuti et al. | 102/435 |
| 5,170,524 | 12/1992 | Vowles | 15/3.51 |
| 5,233,128 | 8/1993 | Lai | 102/511 |
| 5,341,744 | 8/1994 | Shi | 102/442 |

FOREIGN PATENT DOCUMENTS

| | | | |
|---|---|---|---|
| 401594 | 9/1909 | France | 42/95 |
| 2599827 | 12/1987 | France | 42/95 |
| 525660 | 9/1940 | United Kingdom | 102/532 |

*Primary Examiner*—Harold J. Tudor
*Attorney, Agent, or Firm*—Richard L. Miller

[57] ABSTRACT

A firearm barrel cleaning cartridge that includes a hollow, cylindrically-shaped, closed back, and open front shell casing, at least one expandable, generally hemispherically-shaped, rearwardly-facing, and removable wiper, a propellant, and at least one wad. The hollow, cylindrically-shaped, closed back, and open front shell casing contains an internal chamber. The at least one expandable, generally hemispherically-shaped, rearwardly-facing, and removable wiper is contained laterally in the hollow, cylindrically-shaped, closed back, and open front shell casing and divides the internal chamber into a plurality of internal sub-chambers. The propellant is contained in a first internal sub-chamber of the plurality of internal sub-chambers. And, each wad is contained in a respective sub-chamber of each at least one remaining sub-chamber of the plurality of internal sub-chambers, so that when the propellant is activated the at least one wad exits therefrom alternatingly with the at least one expandable, generally hemispherically-shaped, rearwardly-facing, and removable wiper and thereby alternatingly cleaning, wiping, and expelling unwanted debris from an interior surface of a barrel of a typical firearm through a muzzle thereof.

9 Claims, 1 Drawing Sheet

FIREARM BARREL CLEANING CARTRIDGE

BACKGROUND OF THE INVENTION

The present invention relates to a firearm barrel cleaning cartridge. More particularly, the present invention relates to a firearm barrel cleaning cartridge that includes a hollow, cylindrically-shaped, closed back, and open front shell casing, at least one expandable, generally hemispherically-shaped, rearwardly-facing, and removable wiper that is contained in the hollow, cylindrically-shaped, closed back, and open front shell casing, a propellant that is contained in the hollow, cylindrically-shaped, closed back, and open front shell casing, and at least one wad that is contained in the hollow, cylindrically-shaped, closed back, and open front shell casing and alternating with the at least one expandable, generally hemispherically-shaped, rearwardly-facing, and removable wiper.

The discharge of conventional firearms results in deposits of residue on the inside surface of the bore of the firearm. Such deposits, over time, can damage the firearm, impair its performance, and lead to potentially dangerous conditions.

The cleaning of the bore of a firearm by conventional means is a tedious process wherein cleaning wads attached to rods are doused with cleaning solution and run through the bore. Such conventional cleaning is not conveniently effected during hunting trips or tournaments, because of the time involved and the extra hardware which must be carried by the operator of the firearm.

Projectiles constructed to clean the barrel of a gun typically have included scrapers and cleaning elements. Generally, the scraper is arranged on the projectile in advance of the cleaning element for the purpose of loosening the burnt powder or rust from the wall of the bore, so that this dirt or foreign material can be carried out of the barrel by the cleaning element when the projectile is fired. It has been found, however, that these scrapers often do not adequately loosen the gunpowder residue and rust, which then renders the cleaning element essentially ineffective.

Further, muzzle flash and gun barrel erosion are two phenomena which have caused serious problems with past and present guns. Moreover, these problems hinder the development of new energetic gun systems. In an effort to these problems, it has been conventional to use selective additives too reduce flash and erosion of gun barrels. The success of these additives, however, have been system limited because of the problems of packaging the additives in the propelling charge.

Gun barrel erosion has been described, e.g., in "A Study of the Erosion Process Using several Group IV Oxides" by Linchitz, C. and Silvesto, G. Tech Report No. 1869, Picatinny Arsenal, Dover, N.J., December 1968.

Frequently, the packaging of these additives in the propelling charge is an extremely difficult, if not almost insurmountable, feat. It is known, for example, to incorporate relatively benign erosion and flash additives, such as $TiO_2$, talc, $K_2SO_4$, $KNO_3$, in a wax cloth liner if there is sufficient space in the propellant charge. Sometimes, however, space in the propelling charge is at a premium, and introduction of these benign additives in the proper configuration cannot be readily achieved. Also, with more volatile flash reducers, such as $(NH_4)_2CO_3$, $NH_4HCO_3$, and $KHCO_3$, this cannot be accomplished because the temperature required to melt the wax also results in volatization of these additives.

Placement of some of these additives in the propelling charge without proper protection is also unsatisfactory because even at room temperature, sublimation occurs which causes a total loss of flash reducer over a extended period of time. One solution to this space problem has been to package the additives in a non-permeable plastic bag. There is often insufficient space, however, in the propelling charge for the bag of additives.

Numerous innovations for tube cleaning devices have been provided in the prior art that will be described. Even though these innovations may be suitable for the specific individual purposes to which they address, however, they differ from the present invention in that they do not teach a firearm barrel cleaning cartridge that includes a hollow, cylindrically-shaped, closed back, and open front shell casing, at least one expandable, generally hemispherically-shaped, rearwardly-facing, and removable wiper that is contained in the hollow, cylindrically-shaped, closed back, and open front shell casing, a propellant that is contained in the hollow, cylindrically-shaped, closed back, and open front shell casing, and at least one wad that is contained in the hollow, cylindrically-shaped, closed back, and open front shell casing and alternating with the at least one expandable, generally hemispherically-shaped, rearwardly-facing, and removable wiper.

FOR EXAMPLE, U.S. Pat. No. 5,151,557 to Bracuti et al. teaches a propelling charge additive that includes a propellant charge, a propellant-containing bag or propellant-containing container which is coated with a composition for reducing muzzle flash and bun barrel erosion. The composition includes sodium or potassium water glass and a volatile flash suppressant of $NH_4HCO_3$, $(NH_4)_2CO_3$ and/or $KHCO_3$.

ANOTHER EXAMPLE, U.S. Pat. No. 5,170,524 to Vowles teaches a projectile launcher that is adapted for use in an apparatus for cleaning tubes that is arranged in the apparatus of the type whereby a projectile is placed in a tube to be cleaned and then subjected to a sudden cleaning medium pressure impact to force the projectile through the tube at high speed.

STILL ANOTHER EXAMPLE, U.S. Pat. No. 5,233,128 to Lai teaches a barrel cleaning bullet that contains a charge of cleaning fluid and an array of cleaning elements that extend about the exterior surface of the bullet. Upon firing of the bullet, a piston, slidably positioned in the cavity filled by the fluid, forces the fluid through at least one discharge port formed in the head of the bullet.

FINALLY, YET ANOTHER EXAMPLE, U.S. Pat. No. 5,341,744 to Shi teaches an apparatus for cleaning the bore of a firearm that includes a shell housing having a rearwardly oriented base portion, a substantially tubular body defining a cavity, and a forward end, a tank for confining a compressed fluid. The tank is disposed within the cavity of the housing. A cleaning wad for cleaning the bore of the firearm is disposed forward of the tank. And, a rupturing member is disposed between the tank and the cleaning wad.

It is apparent that numerous innovations for tube cleaning devices have been provided in the prior art that are adapted to be used. Furthermore, even though these innovations may be suitable for the specific individual purposes to which they however, they would not be suitable for the purposes of the present invention as heretofore described.

SUMMARY OF THE INVENTION

ACCORDINGLY, AN OBJECT of the present invention is to provide a firearm barrel cleaning cartridge that avoids the disadvantages of the prior art.

ANOTHER OBJECT of the present invention is to provide a firearm barrel cleaning cartridge that is simple and inexpensive to manufacture.

STILL ANOTHER OBJECT of the present invention is to provide a firearm barrel cleaning cartridge that is simple to use.

YET ANOTHER OBJECT of the present invention is to provide a firearm barrel cleaning cartridge that is not only ideal for shooters and hunters, but is also suitable for military heavy weapons, such as cannons, tanks, battle ships, etc.

BRIEFLY STATED, STILL YET ANOTHER OBJECT of the present invention is to provide a firearm barrel cleaning cartridge that includes a hollow, cylindrically-shaped, closed back, and open front shell casing, at least one expandable, generally hemispherically-shaped, rearwardly-facing, and removable wiper, a propellant, and at least one wad.

YET STILL ANOTHER OBJECT of the present invention is to provide a firearm barrel cleaning cartridge wherein the hollow, cylindrically-shaped, closed back, and open front shell casing contains an internal chamber defined by a circular-shaped, inwardly flanged, and open front that has an inward flange, a circular-shaped and closed back that is displaced behind, and parallel to, the circular-shaped, inwardly flanged, and open front of the hollow, cylindrically-shaped, closed back, and open front shell casing, a cylindrically-shaped longitudinal side that extends perpendicularly from the circular-shaped and closed back of the hollow, cylindrically-shaped, closed back, and open front shell casing to the circular-shaped, inwardly flanged, and open front of the hollow, cylindrically-shaped, closed back, and open front shell casing and which has an interior surface and a longitudinal axis.

STILL YET ANOTHER OBJECT of the present invention is to provide a firearm barrel cleaning cartridge wherein the at least one expandable, generally hemispherically-shaped, rearwardly-facing, and removable wiper is contained laterally in the hollow, cylindrically-shaped, closed back, and open front shell casing and divides the internal chamber in the hollow, cylindrically-shaped, closed back, and open front shell casing into a plurality of internal sub-chambers.

YET STILL ANOTHER OBJECT of the present invention is to provide a firearm barrel cleaning cartridge wherein the propellant is contained in a first internal sub-chamber of the plurality of internal sub-chambers of the internal chamber in the hollow, cylindrically-shaped, closed back, and open front shell casing adjacent to the circular-shaped and closed back of the hollow, cylindrically-shaped, closed back, and open front shell casing.

STILL YET ANOTHER OBJECT of the present invention is to provide a firearm barrel cleaning cartridge wherein each wad of the at least one wad is contained in a respective sub-chamber of each at least one remaining sub-chamber of the plurality of internal sub-chambers of the internal chamber in the hollow, cylindrically-shaped, closed back, and open front shell casing, so that when the propellant in the first sub-chamber of the plurality of sub-chambers of the internal chamber in the hollow, cylindrically-shaped, closed back, and open front shell casing is activated each at least one wad that is contained in the respective sub-chamber of each at least one remaining sub-chamber of the plurality of internal sub-chambers of the internal chamber in the hollow, cylindrically-shaped, closed back, and open front shell casing exits therefrom alternatingly with each at least one expandable, generally hemispherically-shaped, rearwardly-facing, and removable wiper that is contained laterally in the hollow, cylindrically-shaped, closed back, and open front shell casing and thereby alternatingly cleaning, wiping, and expelling unwanted debris from an interior surface of a barrel of a typical firearm through a muzzle thereof.

YET STILL ANOTHER OBJECT of the present invention is to provide a firearm barrel cleaning cartridge wherein the circular-shaped and closed back of the hollow, cylindrically-shaped, closed back, and open front shell casing is metallic.

STILL YET ANOTHER OBJECT of the present invention is to provide a firearm barrel cleaning cartridge wherein the cylindrically-shaped longitudinal side of the hollow, cylindrically-shaped, closed back, and open front shell casing is a material selected from the group consisting of fiber board, cellulosic fibers, nitrocellulose, and combinations thereof.

YET STILL ANOTHER OBJECT of the present invention is to provide a firearm barrel cleaning cartridge wherein the circular-shaped and closed back of the hollow, cylindrically-shaped, closed back, and open front shell casing extends radially outwardly from, and circumferentially around, the cylindrically-shaped longitudinal side of the hollow, cylindrically-shaped, closed back, and open front shell casing so as to form a radially-outwardly-extending and circumferentially-disposed circumferential rim therearound.

STILL YET ANOTHER OBJECT of the present invention is to provide a firearm barrel cleaning cartridge wherein each wad of the at least one wad that is contained in the respective sub-chamber of each the at least one remaining sub-chamber of the plurality of internal sub-chambers of the internal chamber in the hollow, cylindrically-shaped, closed back, and open front shell casing is a material selected from the group consisting of fiber, cotton, jute, and combinations thereof.

YET STILL ANOTHER OBJECT of the present invention is to provide a firearm barrel cleaning cartridge wherein the circular-shaped and closed back of the hollow, cylindrically-shaped, closed back, and open front shell casing has a centrally-disposed and inwardly-longitudinally-extending primer cap that extends inwardly therefrom into the internal chamber in the hollow, cylindrically-shaped, closed back, and open front shell casing along the longitudinal axis of the hollow, cylindrically-shaped, closed back, and open front shell casing.

STILL YET ANOTHER OBJECT of the present invention is to provide a firearm barrel cleaning cartridge wherein the circular-shaped, inwardly flanged, and open front of the hollow, cylindrically-shaped, closed back, and open front shell casing is removably closed by a removably mounted and laterally-oriented disk that abuts against the inward flange of the circular-shaped, inwardly flanged, and open front of the hollow, cylindrically-shaped, closed back, and open front shell casing and which is parallel to the circular-shaped and closed back of the hollow, cylindrically-shaped, closed back, and open front shell casing.

YET STILL ANOTHER OBJECT of the present invention is to provide a firearm barrel cleaning cartridge wherein the removably mounted and laterally-oriented disk is a material selected from the group consisting of fiber board, cellulosic fibers, nitrocellulose, and combinations thereof.

STILL YET ANOTHER OBJECT of the present invention is to provide a firearm barrel cleaning cartridge wherein the at least one expandable, generally hemispherically-shaped, rearwardly-facing, and removable wiper that is contained laterally in the hollow, cylindrically-shaped, closed back, and open front shell casing is five expandable, generally hemispherically-shaped, rearwardly-facing, and removable wipers so as to divide the plurality of internal sub-chambers of the internal chamber in the hollow, cylindrically-shaped, closed back, and open front shell casing into six internal sub-chambers.

YET STILL ANOTHER OBJECT of the present invention is to provide a firearm barrel cleaning cartridge wherein the six internal sub-chambers of the internal chamber in the hollow, cylindrically-shaped, closed back, and open front shell casing further includes a second internal sub-chamber disposed adjacent to the first internal sub-chamber of the six internal sub-chambers of the internal chamber in the hollow, cylindrically-shaped, closed back, and open front shell casing and is separated therefrom by a first expandable, generally hemispherically-shaped, rearwardly-facing, and removable wiper of the five expandable, generally hemispherically-shaped, rearwardly-facing, and removable wipers in the hollow, cylindrically-shaped, closed back, and open front shell casing.

STILL YET ANOTHER OBJECT of the present invention is to provide a firearm barrel cleaning cartridge wherein the six internal sub-chambers of the internal chamber in the hollow, cylindrically-shaped, closed back, and open front shell casing further includes a third internal sub-chamber disposed adjacent to the second internal sub-chamber of the six internal sub-chambers of the internal chamber in the hollow, cylindrically-shaped, closed back, and open front shell casing and is separated therefrom by a second expandable, generally hemispherically-shaped, rearwardly-facing, and removable wiper of the five expandable, generally hemispherically-shaped, rearwardly-facing, and removable wipers in the hollow, cylindrically-shaped, closed back, and open front shell casing.

YET STILL ANOTHER OBJECT of the present invention is to provide a firearm barrel cleaning cartridge wherein the six internal sub-chambers of the internal chamber in the hollow, cylindrically-shaped, closed back, and open front shell casing further includes a fourth internal sub-chamber disposed adjacent to the third internal sub-chamber of the six internal sub-chambers in the hollow, cylindrically-shaped, closed back, and open front shell casing and is separated therefrom by a third expandable, generally hemispherically-shaped, rearwardly-facing, and removable wiper of the five expandable, generally hemispherically-shaped, rearwardly-facing, and removable wipers in the hollow, cylindrically-shaped, closed back, and open front shell casing.

STILL YET ANOTHER OBJECT of the present invention is to provide a firearm barrel cleaning cartridge wherein the six internal sub-chambers of the internal chamber in the hollow, cylindrically-shaped, closed back, and open front shell casing further includes a fifth internal sub-chamber disposed adjacent to the fourth internal sub-chamber of the six internal sub-chambers of the internal chamber in the hollow, cylindrically-shaped, closed back, and open front shell casing and is separated therefrom by a fourth expandable, generally hemispherically-shaped, rearwardly-facing, and removable wiper of the five generally hemispherically-shaped, rearwardly-facing, and removable wipers in the hollow, cylindrically-shaped, closed back, and open front shell casing.

YET STILL ANOTHER OBJECT of the present invention is to provide a firearm barrel cleaning cartridge wherein the six internal sub-chambers of the internal chamber in the hollow, cylindrically-shaped, closed back, and open front shell casing further includes a sixth internal sub-chamber disposed adjacent to the fifth internal sub-chamber of the six internal sub-chambers of the internal chamber in the hollow, cylindrically-shaped, closed back, and open front shell casing and is separated therefrom by a fifth expandable, generally hemispherically-shaped, rearwardly-facing, and removable wiper of the five generally hemispherically-shaped, rearwardly-facing, and removable wipers in the hollow, cylindrically-shaped, closed back, and open front shell casing and is further defined by the circular-shaped, inwardly flanged, and open front of the hollow, cylindrically-shaped, closed back, and open front shell casing.

STILL YET ANOTHER OBJECT of the present invention is to provide a firearm barrel cleaning cartridge wherein the at least one wad includes a first wad that is contained in the sixth internal sub-chamber of the six internal sub-chambers of the internal chamber in the hollow, cylindrically-shaped, closed back, and open front shell casing that is impregnated with a cleaning solvent and is first to exit the hollow, cylindrically-shaped, closed back, and open front shell casing when the propellant in the first sub-chamber of the six sub-chambers of the internal chamber in the hollow, cylindrically-shaped, closed back, and open front shell casing is activated, so that the first wad of the at least one wad that is contained in the sixth internal sub-chamber of the six internal sub-chambers of the internal chamber in the hollow, cylindrically-shaped, closed back, and open front shell casing provides a first layer of the cleaning solvent onto the interior surface of the barrel of the typical rifle as the first wad moves therealong which dissolves and expels a portion of the unwanted debris from the interior surface of the barrel of the typical firearm through the muzzle thereof.

YET STILL ANOTHER OBJECT of the present invention is to provide a firearm barrel cleaning cartridge wherein the fifth expandable, generally hemispherically-shaped, rearwardly-facing, and removable wiper of the five expandable, generally hemispherically-shaped, rearwardly-facing, and removable wipers is second to exit from the hollow, cylindrically-shaped, closed back, and open front shell casing when the propellant in the first sub-chamber of the six sub-chambers of the internal chamber in the hollow, cylindrically-shaped, closed back, and open front shell casing is activated, so that the fifth expandable, generally hemispherically-shaped, rearwardly-facing, and removable wiper of the five expandable, generally hemispherically-shaped, rearwardly-facing, and removable wipers that is contained in the hollow, cylindrically-shaped, closed back, and open front shell casing wipes off and expels another portion of the unwanted debris from the interior surface of the barrel of the typical firearm through the muzzle thereof as the first wad moves therealong.

STILL YET ANOTHER OBJECT of the present invention is to provide a firearm barrel cleaning cartridge wherein the at least one wad includes a second wad that is contained in the fifth internal sub-chamber of the six internal sub-chambers of the internal chamber in the hollow, cylindrically-shaped, closed back, and open front shell casing that is dry and is third to exit from the hollow, cylindrically-shaped, closed back, and open front shell casing when the propellant in the first sub-chamber of the six of sub-chambers of the internal chamber in the hollow, cylindrically-shaped, closed back, and open front shell casing is activated, so that the second wad of the at least one wad that is contained in the fifth internal sub-chamber of the six internal sub-chambers of the internal chamber in the hollow, cylindrically-shaped, closed back, and open front shell casing absorbs and expels another portion of the unwanted debris from the interior surface of the barrel of the typical firearm through the muzzle thereof as the second wad moves therealong.

YET STILL ANOTHER OBJECT of the present invention is to provide a firearm barrel cleaning cartridge wherein the fourth expandable, generally hemispherically-shaped, rearwardly-facing, and removable wiper of the expandable, generally hemispherically-shaped, rearwardly-facing, and removable wipers is fourth to exit from the hollow, cylindrically-shaped, closed back, and open front shell casing when the propellant in the first sub-chamber of the six sub-chambers of the internal chamber in the hollow, cylindrically-shaped, closed back, and open front shell casing is activated, so that the fourth expandable, generally hemispherically-shaped, rearwardly-facing, and removable wiper of the five expandable, generally hemispherically-shaped, rearwardly-facing, and removable wipers that is contained in the hollow, cylindrically-shaped, closed back, and open front shell casing wipes off and expels another portion of the unwanted debris from the interior surface of the barrel of the typical firearm through the muzzle thereof as the fourth expandable, generally hemispherically-shaped, rearwardly-facing, and removable wiper moves therealong.

STILL YET ANOTHER OBJECT of the present invention is to provide a firearm barrel cleaning cartridge wherein the at least one wad includes a third wad that is contained in the fourth internal sub-chamber of the six internal sub-chambers of the internal chamber in the hollow, cylindrically-shaped, closed back, and open front shell casing that is impregnated with the cleaning solvent and is fifth to exit from the hollow, cylindrically-shaped, closed back, and open front shell casing when the propellant in the first sub-chamber of the six sub-chambers of the internal chamber in the hollow, cylindrically-shaped, closed back, and open front shell casing is activated, so that the third wad of the at least one wad that is contained in the fourth internal sub-chamber of the six internal sub-chambers of the internal chamber in the hollow, cylindrically-shaped, closed back, and open front shell casing provides a second layer of the cleaning solvent on the interior surface of the barrel of the typical rifle as the third wad moves therealong which dissolves and expels another portion of the unwanted debris from the interior surface of the barrel of the typical firearm through the muzzle thereof.

YET STILL ANOTHER OBJECT of the present invention is to provide a firearm barrel cleaning cartridge wherein the third expandable, generally hemispherically-shaped, rearwardly-facing, and removable wiper of the five expandable, generally hemispherically-shaped, rearwardly-facing, and removable wipers that is sixth to exit from the hollow, cylindrically-shaped, closed back, and open front shell casing when the propellant in the first sub-chamber of the six sub-chambers of the internal chamber in the hollow, cylindrically-shaped, closed back, and open front shell casing is activated, so that the third expandable, generally hemispherically-shaped, rearwardly-facing, and removable wiper of the five expandable, generally hemispherically-shaped, rearwardly-facing, and removable wipers that is contained in the hollow, cylindrically-shaped, closed back, and open front shell casing wipes off and expels another portion of the unwanted debris from the interior surface of the barrel of the typical firearm through the muzzle thereof as the third expandable, generally hemispherically-shaped, rearwardly-facing, and removable wiper moves therealong.

STILL YET ANOTHER OBJECT of the present invention is to provide a firearm barrel cleaning cartridge wherein the at least one wad includes a fourth wad that is contained in the third internal sub-chamber of the six internal sub-chambers of the internal chamber in the hollow, cylindrically-shaped, closed back, and open front shell casing that is dry and is seventh to exit from the hollow, cylindrically-shaped, closed back, and open front shell casing when the propellant in the first sub-chamber of the six internal sub-chambers of the internal chamber in the hollow, cylindrically-shaped, closed back, and open front shell casing is activated, so that the fourth wad of the at least one wad that is contained in the third internal sub-chamber of the six internal sub-chambers of the internal chamber in the hollow, cylindrically-shaped, closed back, and open front shell casing absorbs and expels another portion of the unwanted debris from the interior surface of the barrel of the typical firearm through the muzzle thereof as the fourth wad moves therealong.

YET STILL ANOTHER OBJECT of the present invention is to provide a firearm barrel cleaning cartridge wherein the second expandable, generally hemispherically-shaped, rearwardly-facing, and removable wiper of the five expandable, generally hemispherically-shaped, rearwardly-facing, and removable wipers is eighth to exit from the hollow, cylindrically-shaped, closed back, and open front shell casing when the propellant in the first sub-chamber of the six sub-chambers of the internal chamber in the hollow, cylindrically-shaped, closed back, and open front shell casing is activated, so that the second expandable, generally hemispherically-shaped, rearwardly-facing, and removable wiper of the five expandable, generally hemispherically-shaped, rearwardly-facing, and removable wipers that is contained in the hollow, cylindrically-shaped, closed back, and open front shell casing wipes off and expels another portion of the unwanted debris from the interior surface of the barrel of the typical firearm through the muzzle thereof as the second expandable, generally hemispherically-shaped, rearwardly-facing, and removable wiper moves therealong.

STILL YET ANOTHER OBJECT of the present invention is to provide a firearm barrel cleaning cartridge wherein the at least one wad includes a fifth wad that is contained in the second internal sub-chamber of the six internal sub-chambers of the internal chamber in the hollow, cylindrically-shaped, closed back, and open front shell casing that is impregnated with a muzzle flash and barrel erosion reduction composition and is ninth to exit from the hollow, cylindrically-shaped, closed back, and open front shell casing when the propellant in the first sub-chamber of the six sub-chambers of the internal chamber in the hollow, cylindrically-shaped, closed back, and open front shell casing is activated, so that the fifth wad of the at least one wad that is contained in the second internal sub-chamber of the six internal sub-chambers of the internal chamber in the hollow, cylindrically-shaped, closed back, and open front shell casing provides a layer of the muzzle flash and barrel erosion reduction composition on the interior surface of the barrel of the typical firearm as the fifth wad moves therealong.

YET STILL ANOTHER OBJECT of the present invention is to provide a firearm barrel cleaning cartridge wherein the first expandable, generally hemispherically-shaped, rearwardly-facing, and removable wiper of the five expandable, generally hemispherically-shaped, rearwardly-facing, and removable wiper is tenth to exit from the hollow, cylindrically-shaped, closed back, and open front shell casing when the propellant in the first sub-chamber of the six sub-chambers of the internal chamber in the hollow, cylindrically-shaped, closed back, and open front shell casing is activated, so that the first expandable, generally hemispherically-shaped, rearwardly-facing, and removable wiper of the five expandable, generally hemispherically-shaped, rearwardly-facing, and removable wipers that is contained in the hollow, cylindrically-shaped, closed back, and open front shell casing smooths out the layer of the muzzle flash and barrel erosion reduction composition on the interior surface of the barrel of the typical firearm as the first expandable, generally hemispherically-shaped, rearwardly-facing, and removable wiper moves therealong and provides a smooth coating thereon.

STILL YET ANOTHER OBJECT of the present invention is to provide a firearm barrel cleaning cartridge wherein the muzzle flash and barrel erosion reduction composition is an aqueous solution of a material selected from the group consisting of $Na_2O_xSiO_2$, $K_2O_xSiO_2$, and combinations thereof, wherein x is 3–5, and which can be impregnated at ambient temperature and at atmospheric pressure, and wherein $SiO_2$ acts as an erosion reducer.

YET STILL ANOTHER OBJECT of the present invention is to provide a firearm barrel cleaning cartridge wherein the material is about 5%–20% by weight.

STILL YET ANOTHER OBJECT of the present invention is to provide a firearm barrel cleaning cartridge wherein the material is a loose dry powder.

YET STILL ANOTHER OBJECT of the present invention is to a provide a firearm barrel cleaning cartridge wherein the muzzle flash and barrel erosion reduction composition further contains small quantities of an additional material selected from the group consisting of talc, $TiO_2$, and combinations thereof.

STILL YET ANOTHER OBJECT of the present invention is to provide a firearm barrel cleaning cartridge wherein the muzzle flash and barrel erosion reduction composition further contains a flash suppressant selected from the group consisting of volatile and non-volatile.

YET STILL ANOTHER OBJECT of the present invention is to provide a firearm barrel cleaning cartridge wherein the volatile flash suppressant is selected from the group consisting of $NH_4HCO_3$, $(NH_4)_2CO_3$, and $KHCO_3$.

STILL YET ANOTHER OBJECT of the present invention is to provide a firearm barrel cleaning cartridge wherein the flash suppressant is about 3%–6% by weight.

FINALLY, YET STILL ANOTHER OBJECT of the present invention is to provide a method of using a firearm barrel cleaning cartridge to clean and coat an interior surface of a barrel of a typical firearm with a muzzle flash and erosion reduction compound that includes the steps of inserting the firearm barrel cleaning cartridge into the barrel of the typical firearm whose interior surface is to be cleaned and coated, activating a propellant that is contained in a first internal sub-chamber of an internal chamber in a hollow, cylindrically-shaped, closed back, and open front shell casing of the firearm barrel cleaning cartridge, expelling a first removable wad that is impregnated with a cleaning solvent from a second internal sub-chamber of the internal chamber in the hollow, cylindrically-shaped, closed back, and open front shell casing, depositing the cleaning solvent on the interior surface of the barrel of the typical firearm as the first removable wad moves therealong, dissolving and expelling a portion of the unwanted deposits from the interior surface of the barrel of the typical firearm through the muzzle thereof as the first removable wad moves therealong, expelling a first expandable, generally hemispherically-shaped, rearwardly-facing, and removable wiper from the hollow, cylindrically-shaped, closed back, and open front shell casing, expanding the first expandable, generally hemispherically-shaped, rearwardly-facing, and removable wiper so as to contact the interior surface of the barrel of the typical firearm as the first expandable, generally hemispherically-shaped, rearwardly-facing, and removable wiper moves therealong, wiping off and expelling another portion of the unwanted deposits from the interior surface of the barrel of the typical firearm through the muzzle thereof as the first expandable, generally hemispherically-shaped, rearwardly-facing, and removable wiper moves therealong, expelling a second removable wad that is dry from a third internal sub-chamber of the internal chamber, absorbing and expelling another portion of the unwanted deposits from the interior surface of the barrel of the typical firearm through the muzzle thereof as the second removable wad moves therealong, expelling a second expandable, generally hemispherically-shaped, rearwardly-facing, and removable wiper from the hollow, cylindrically-shaped, closed back, and open front shell casing, expanding the second expandable, generally hemispherically-shaped, rearwardly-facing, and removable wiper so as to contact the interior surface of the barrel of the typical firearm as the second expandable, generally hemispherically-shaped, rearwardly-facing, and removable wiper moves therealong, wiping off and expelling another portion of the unwanted deposits from the interior surface of the barrel of the typical firearm through the muzzle thereof as the second expandable, generally hemispherically-shaped, rearwardly-facing, and removable wiper moves therealong, expelling a third removable wad that is impregnated with the cleaning solvent from a fourth internal sub-chamber of the internal chamber in the hollow, cylindrically-shaped, closed back, and open front shell casing, depositing the cleaning solvent on the interior surface of the barrel of the typical firearm as the third removable wad moves therealong, dissolving and expelling another portion of the unwanted deposits from the interior surface of the barrel of the typical firearm through the muzzle thereof as the third removable wad moves therealong, expelling a third expandable, generally hemispherically-shaped, rearwardly-facing, and removable wiper from the hollow, cylindrically-shaped, closed back, and open front shell casing, expanding the third expandable, generally hemispherically-shaped, rearwardly-facing, and removable wiper so as to contact the interior surface of the barrel of the typical firearm as the third expandable, generally hemispherically-shaped, rearwardly-facing, and removable wiper moves therealong, wiping off and expelling another portion of the unwanted deposits from the interior surface of the barrel of the typical firearm through the muzzle thereof as the third expandable, generally hemispherically-shaped, rearwardly-facing, and removable wiper moves therealong, expelling a fourth removable wad that is dry from a fifth internal sub-chamber of the internal chamber in the hollow, cylindrically-shaped, closed back, and open front shell casing, absorbing and expelling another portion of the unwanted deposits from the interior surface of the barrel of the typical firearm through the muzzle thereof as the fourth removable wad moves therealong, expelling a fourth expandable, generally hemispherically-shaped, rearwardly-facing, and removable wiper from the hollow, cylindrically-shaped, closed back, and open front shell casing, expanding the fourth expandable, generally hemispherically-shaped, rearwardly-facing, and removable wiper so as to contact the interior surface of the barrel of the typical firearm as the fourth expandable, generally hemispherically-shaped, rearwardly-facing, and removable wiper moves therealong, wiping off and expelling another portion of the unwanted deposits from the interior surface of the barrel of the typical firearm through the muzzle thereof as the fourth expandable, generally hemispherically-shaped, rearwardly-facing, and removable wiper moves therealong, expelling a fifth removable wad that is impregnated with a muzzle flash and barrel erosion reduction composition from a sixth internal sub-chamber of the internal chamber in the hollow, cylindrically-shaped, closed back, and open front shell casing, depositing the muzzle flash and barrel erosion reduction composition on the interior surface of the barrel of the typical firearm as the fifth removable wad moves therealong, expelling a fifth expandable, generally hemispherically-shaped, rearwardly-facing, and removable wiper from the hollow, cylindrically-shaped, closed back, and open front shell casing, expanding the fifth expandable, generally hemispherically-shaped, rearwardly-facing, and removable wiper so as to contact the interior surface of the barrel of the typical firearm as the fifth expandable, generally hemispherically-shaped, rearwardly-facing, and removable wiper moves therealong, and smoothing out the muzzle flash and barrel erosion reduction composition on the interior surface of the barrel of the typical firearm as the fifth expandable, generally hemispherically-shaped, rearwardly-facing, and removable wiper moves therealong.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

Figure 2:
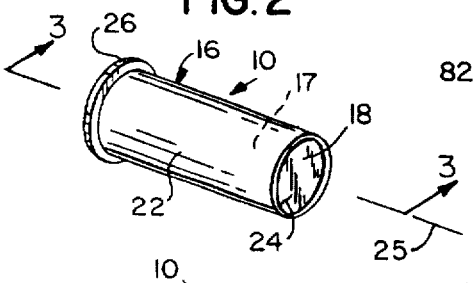
FIG. 2 is an enlarged diagrammatic perspective view of the present invention.

LIST OF REFERENCE NUMERALS UTILIZED IN THE DRAWING firearm barrel cleaning cartridge of the present invention
12 typical firearm barrel
14 typical firearm
16 hollow, cylindrically-shaped, closed back, and open front shell casing
17 shell casing internal chamber
18 shell casing circular-shaped, inwardly flanged, and open front
20 shell casing circular-shaped and closed back
22 shell casing cylindrically-shaped longitudinal side
24 shell casing longitudinal side interior surface
25 shell casing longitudinal axis
26 shell casing back radially-outwardly-extending and circumferentially-disposed rim
28 shell casing back centrally-disposed and inwardly-longitudinally-extending primer cap
30 shell casing removably mounted and laterally-oriented disk
32 shell casing internal chamber first internal sub-chamber
34 shell casing internal chamber second internal sub-chamber
36 expandable, generally hemispherically-shaped, rearwardly-facing, and removable first wiper
38 first wiper circular-shaped perimeter
40 shell casing internal chamber third internal sub-chamber
42 expandable, generally hemispherically-shaped, rearwardly-facing, and removable second wiper
44 second wiper circular-shaped perimeter
46 shell casing internal chamber fourth internal sub-chamber
40 expandable, generally hemispherically-shaped, rearwardly-facing, and removable third wiper
50 third wiper circular-shaped perimeter
52 shell casing internal chamber fifth internal sub-chamber
54 expandable, generally hemispherically-shaped, rearwardly-facing, and removable fourth wiper
56 fourth wiper circular-shaped perimeter
58 shell casing internal chamber sixth internal sub-chamber
60 expandable, generally hemispherically-shaped, rearwardly-facing, and removable fifth wiper
62 fifth wiper circular-shaped perimeter
64 shell casing internal chamber first internal sub-chamber propellant
66 shell casing internal chamber second internal sub-chamber removable wad
68 shell casing internal chamber third internal sub-chamber removable wad
70 shell casing internal chamber fourth internal sub-chamber removable wad
72 shell casing internal chamber fifth internal sub-chamber removable wad
74 shell casing internal chamber sixth internal sub-chamber removable wad
76 shell casing internal chamber second internal sub-chamber removable wad impregnated muzzle flash and barrel erosion reduction composition
78 shell casing internal chamber fourth internal sub-chamber removable wad impregnated cleaning solvent
80 shell casing internal chamber sixth internal sub-chamber removable wad impregnated cleaning solvent
82 smooth flash and barrel erosion reduction composition coating

DETAILED DESCRIPTION OF THE PREFERRED EMBODIMENT

Figure 1:
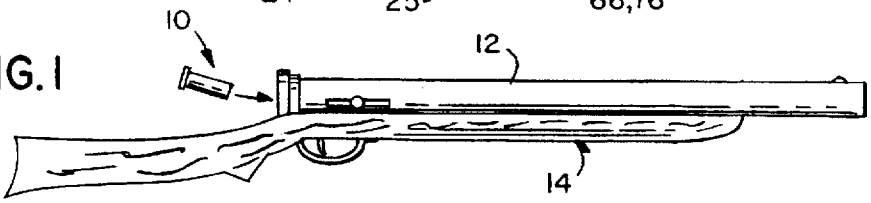
FIG. 1 is a diagrammatic side elevational view of the present invention in the process of being inserted into a barrel of a typical firearm that is to be cleaned and coated therewith.

Referring now to the figures in which like numerals indicate like parts, and particularly to FIG. 1 which is a diagrammatic side elevational view, the firearm barrel cleaning cartridge of the present invention is shown generally at 10 in the process of being inserted into a typical firearm barrel 12 of a typical firearm 14 that the firearm barrel cleaning cartridge 10 is going to clean and coat.

The configuration of the firearm barrel cleaning cartridge 10 can best be seen in FIGS. 2–4, and as such will be discussed with reference thereto.

As shown in FIG. 2, which is a perspective view of the firearm barrel cleaning cartridge 10, the firearm barrel cleaning cartridge 10 includes a hollow, cylindrically-shaped, closed back, and open front shell casing 16 that contains a shell casing internal chamber 17 defined by a shell casing circular-shaped, inwardly flanged, and open front 18, a shell casing circular-shaped and closed back 20 that is displaced behind, and parallel to, the shell casing circular-shaped, inwardly flanged, and open front 18 of the hollow, cylindrically-shaped, closed back, and open front shell casing 16, a shell casing cylindrically-shaped longitudinal side 22 that extends perpendicularly from the shell casing circular-shaped and closed back 20 of the hollow, cylindrically-shaped, closed back, and open front shell casing 16 to the shell casing circular-shaped, inwardly flanged, and open front 18 of the hollow, cylindrically-shaped, closed back, and open front shell casing 16 and which has a shell casing longitudinal side interior surface 24 and a shell casing longitudinal axis 25.

The shell casing circular-shaped and closed back 20 of the hollow, cylindrically-shaped, closed back, and open front shell casing 16 is preferably metallic.

The shell casing cylindrically-shaped longitudinal side 20 of the hollow, cylindrically-shaped, closed back, and open front shell casing 16 is preferably formed typically of fiber board or cellulosic fibers and nitrocellulose.

The shell casing circular-shaped and closed back 20 of the hollow, cylindrically-shaped, closed back, and open front shell casing 16 extends radially outwardly from, and circumferentially around, the shell casing cylindrically-shaped longitudinal side 22 of the hollow, cylindrically-shaped, closed back, and open front shell casing 16 so as to form a shell casing back radially-outwardly-extending and circumferentially-disposed rim 26.

Figure 3:
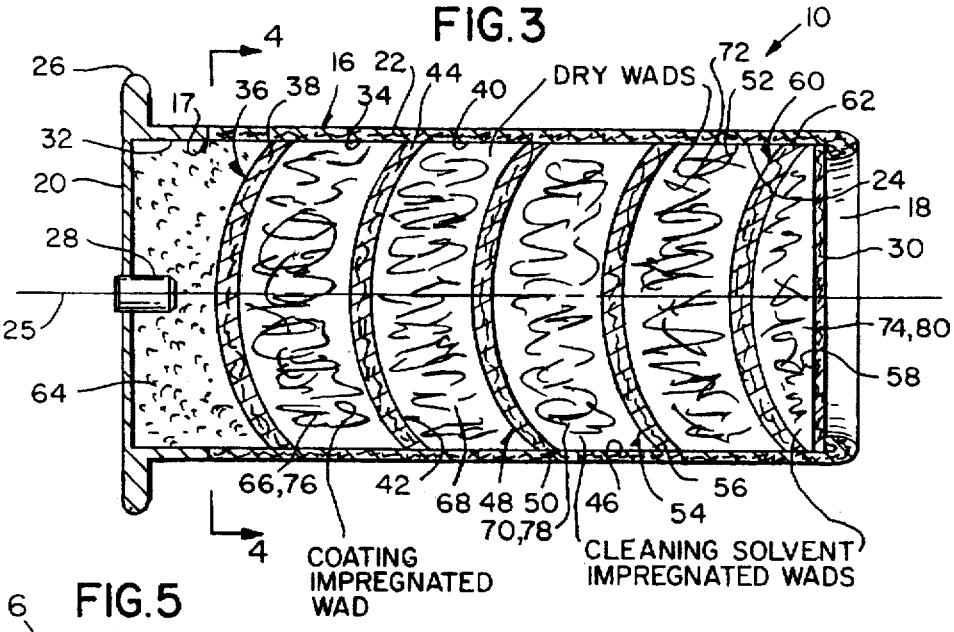
FIG. 3 is an enlarged cross sectional view taken on line 3—3 in FIG. 2.

As shown in FIG. 3, which is an enlarged cross sectional view taken on line 3—3 in FIG. 2, the shell casing circular-shaped and closed back 20 of the hollow, cylindrically-shaped, closed back, and open front shell casing 16 has a shell casing back centrally-disposed and inwardly-longitudinally-extending primer cap 28 that extends inwardly therefrom into the shell casing internal chamber 17 in the hollow, cylindrically-shaped, closed back, and open front shell casing 16 along the shell casing longitudinal axis 25 of the hollow, cylindrically-shaped, closed back, and open front shell casing 16.

The shell casing circular-shaped, inwardly flanged, and open front 18 of the hollow, cylindrically-shaped, closed back, and open front shell casing 16 is removably closed by a shell casing removably mounted and laterally-oriented disk 30 that abuts against the inward flange of the shell casing circular-shaped, inwardly flanged, and open front 18 of the hollow, cylindrically-shaped, closed back, and open front shell casing 16 and which is parallel to the shell casing circular-shaped and closed back 20 of the hollow, cylindrically-shaped, closed back, and open front shell casing 16.

The shell casing removably mounted and laterally-oriented disk 30 is also preferably formed typically of fiber board or cellulosic fibers and nitrocellulose.

The shell casing internal chamber 17 in the hollow, cylindrically-shaped, closed back, and open front shell casing 16 is divided laterally into six sub-chambers by five wipers.

The shell casing internal chamber 17 in the hollow, cylindrically-shaped, closed back, and open front shell casing 16 includes a shell casing internal chamber first internal sub-chamber 32 that is adjacent to the shell casing circular-shaped and closed back 20 of the hollow, cylindrically-shaped, closed back, and open front shell casing 16.

The shell casing internal chamber 17 in the hollow, cylindrically-shaped, closed back, and open front shell casing 16 further includes a shell casing internal chamber second internal sub-chamber 34 that is adjacent to the shell casing internal chamber first internal sub-chamber 32 of the shell casing internal chamber 17 in the hollow, cylindrically-shaped, closed back, and open front shell casing 16 and is separated therefrom by an expandable, generally hemispherically-shaped, rearwardly-facing, and removable first wiper 36 that has a first wiper circular-shaped perimeter 38 that is coincident with, and slidably contacts, the shell casing longitudinal side interior surface 24 of the shell casing cylindrically-shaped longitudinal side 22 of the hollow, cylindrically-shaped, closed back, and open front shell casing 16.

The shell casing internal chamber 17 in the hollow, cylindrically-shaped, closed back, and open front shell casing 16 further includes a shell casing internal chamber third internal sub-chamber 40 that is adjacent to the shell casing internal chamber second internal sub-chamber 34 of the shell casing internal chamber 17 in the hollow, cylindrically-shaped, closed back, and open front shell casing 16 and is separated therefrom by an expandable, generally hemispherically-shaped, rearwardly-facing, and removable second wiper 42 that has a second wiper circular-shaped perimeter 44 that is coincident with, and slidably contacts, the shell casing longitudinal side interior surface 24 of the shell casing cylindrically-shaped longitudinal side 22 of the hollow, cylindrically-shaped, closed back, and open front shell casing 16.

The shell casing internal chamber 17 in the hollow, cylindrically-shaped, closed back, and open front shell casing 16 further includes a shell casing internal chamber fourth internal sub-chamber 46 that is adjacent to the shell casing internal chamber third internal sub-chamber 40 of the shell casing internal chamber 17 in the hollow, cylindrically-shaped, closed back, and open front shell casing 16 and is separated therefrom by an expandable, generally hemispherically-shaped, rearwardly-facing, and removable third wiper 48 that has a third wiper circular-shaped perimeter 50 that is coincident with, and slidably contacts, the shell casing longitudinal side interior surface 24 of the shell casing cylindrically-shaped longitudinal side 22 of the hollow, cylindrically-shaped, closed back, and open front shell casing 16.

The shell casing internal chamber 17 in the hollow, cylindrically-shaped, closed back, and open front shell casing 16 further includes a shell casing internal chamber fifth internal sub-chamber 52 that is adjacent to the shell casing internal chamber fourth internal sub-chamber 46 of the shell casing internal chamber 17 in the hollow, cylindrically-shaped, closed back, and open front shell casing 16 and is separated therefrom by an expandable, generally hemispherically-shaped, rearwardly-facing, and removable fourth wiper 54 that has a fourth wiper circular-shaped perimeter 56 that is coincident with, and slidably contacts, the shell casing longitudinal side interior surface 24 of the shell casing cylindrically-shaped longitudinal side 22 of the hollow, cylindrically-shaped, closed back, and open front shell casing 16.

The shell casing internal chamber 17 in the hollow, cylindrically-shaped, closed back, and open front shell casing 16 further includes a shell casing internal chamber sixth internal sub-chamber 58 that is adjacent to the shell casing internal chamber fifth internal sub-chamber 52 of the shell casing internal chamber 17 in the hollow, cylindrically-shaped, closed back, and open front shell casing 16 and is separated therefrom by an expandable, generally hemispherically-shaped, rearwardly-facing, and removable fifth wiper 60 that has a fifth wiper circular-shaped perimeter 62 that is coincident with, and slidably contacts, the shell casing longitudinal side interior surface 24 of the shell casing cylindrically-shaped longitudinal side 22 of the hollow, cylindrically-shaped, closed back, and open front shell casing 16.

Figure 4:
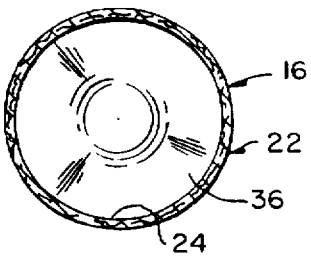
FIG. 4 is a cross sectional view taken on line 4—4 in FIG. 3 with the propellant removed so as to clearly illustrate the convex portion of the hemispherically-shaped additive wiper.

The general hemispherical shape and rearward facing of the five wipers and the coincidence of their perimeters with the shell casing longitudinal side interior surface 24 of the shell casing cylindrically-shaped longitudinal side 22 of the hollow, cylindrically-shaped, closed back, and open front shell casing 16 can best be seen in FIG. 4 which is a cross sectional view taken on line 4—4 in FIG. 3. For the sake of brevity, however, only the expandable, generally hemispherically-shaped, rearwardly-facing, and removable first wiper 36 is shown but it is to be understood that the remaining five wipers have the identical configuration thereto.

The shell casing internal chamber first internal sub-chamber 32 of the shell casing internal chamber 17 in the hollow, cylindrically-shaped, closed back, and open front shell casing 16 is filled with a shell casing internal chamber first internal sub-chamber propellant 64.

The shell casing internal chamber second internal sub-chamber 34 of the shell casing internal chamber 17 in the hollow, cylindrically-shaped, closed back, and open front shell casing 16 is filled with a shell casing internal chamber second internal sub-chamber removable wad 66 that is preferably made of fiber, cotton, or jute.

The shell casing internal chamber third internal sub-chamber 40 of the shell casing internal chamber 17 in the hollow, cylindrically-shaped, closed back, and open front shell casing 16 is filled with a shell casing internal chamber third internal sub-chamber removable wad 68 that is also preferably made of fiber, cotton, or jute.

The shell casing internal chamber fourth internal sub-chamber 46 of the shell casing internal chamber 17 in the hollow, cylindrically-shaped, closed back, and open front shell casing 16 is filled with a shell casing internal chamber fourth internal sub-chamber removable wad 70 that is also preferably made of fiber, cotton, or jute.

The shell casing internal chamber fifth internal sub-chamber 52 of the shell casing internal chamber 17 in the hollow, cylindrically-shaped, closed back, and open front shell casing 16 is filled with a shell casing internal chamber fifth internal sub-chamber removable wad 72 that is also preferably made of fiber, cotton, or jute.

The shell casing internal chamber sixth internal sub-chamber 58 of the shell casing internal chamber 17 in the hollow, cylindrically-shaped, closed back, and open front shell casing 16 is filled with a shell casing internal chamber sixth internal sub-chamber removable wad 74 that is also preferably made of fiber, cotton, or jute.

The shell casing internal chamber second internal sub-chamber removable wad 66 of the shell casing internal chamber second internal sub-chamber 34 of the shell casing internal chamber 17 in the hollow, cylindrically-shaped, closed back, and open front shell casing 16 can be impregnated with a shell casing internal chamber second internal sub-chamber removable wad impregnated muzzle flash and barrel erosion reduction composition 76.

It has been, surprisingly, discovered that muzzle flash and gun barrel erosion can be reduced by an aqueous solution of a water glass. Typical suitable water glasses comprise $Na_2O_xSiO_2$ or $K_2O_xSiO_2$ or mixtures thereof, wherein x is 3–5.

The water glass is particularly advantageous because it is soluble in an aqueous solution. Preferably, the aqueous solution contains from 5%–40%, more preferably from about 5%–20% by weight of the water glass. The solution can also contain small quantities of talc or $TiO_2$. Advantageously, the aqueous solution containing the water glass can be impregnated at ambient temperature and at atmospheric pressure.

Preferably, the solution also contains either a volatile or non-volatile flash suppressant which can be mixed with the water glass. Preferred volatile flash suppressants include $NH_4HCO_3$, $(NH_4)_2CO_3$, and $KHCO_3$. The volatile flash suppressant can be used with the water glass in amounts of from about 3%–26%, more preferably from about 3%–6% by weight. When preparing the aqueous solution, the volatile flash suppressant can be added to the solution either before or after the water glass, although it is preferred to add the water glass to the solution before the flash suppressant is introduced.

The $SiO_2$ acts as an erosion reducer when the charge is fired, and if potassium water glass is used, a source of potassium flash suppressant is supplied to the propellant gases.

The water glass may be added in several different ways. The first addition technique is to add loose dry water glass powder. A second technique is to include 50/50 mixtures of dry water glass/ammonium bicarbonate and a water glass gel containing 60% water glass and 40% ammonium bicarbonate with a total amount of ammonium bicarbonate of 8%.

The shell casing internal chamber third internal sub-chamber removable wad 68 of the shell casing internal chamber third internal sub-chamber 40 of the shell casing internal chamber 17 in the hollow, cylindrically-shaped, closed back, and open front shell casing 16 can be dry.

The shell casing internal chamber fourth internal sub-chamber removable wad 70 of the shell casing internal chamber fourth internal sub-chamber 46 of the shell casing internal chamber 17 in the hollow, cylindrically-shaped, closed back, and open front shell casing 16 can be impregnated with a shell casing internal chamber fourth internal sub-chamber removable wad impregnated cleaning solvent 78.

The shell casing internal chamber fifth internal sub-chamber removable wad 72 of the shell casing internal chamber fifth internal sub-chamber 52 of the shell casing internal chamber 17 in the hollow, cylindrically-shaped, closed back, and open front shell casing 16 can also be dry.

The shell casing internal chamber sixth internal sub-chamber removable wad 74 of the shell casing internal chamber sixth internal sub-chamber 58 of the shell casing internal chamber 17 in the hollow, cylindrically-shaped, closed back, and open front shell casing 16 can also be impregnated with a shell casing internal chamber sixth internal sub-chamber removable wad impregnated cleaning solvent 80.

The operation of the firearm barrel cleaning cartridge 10 can best be seen in FIGS. 1, 5 and 6, and as such will be discussed with reference thereto.

As shown in FIG. 1, the firearm barrel cleaning cartridge 10 is inserted into the typical firearm barrel 12 that the firearm barrel cleaning cartridge 10 is going to clean and coat.

Figure 5:
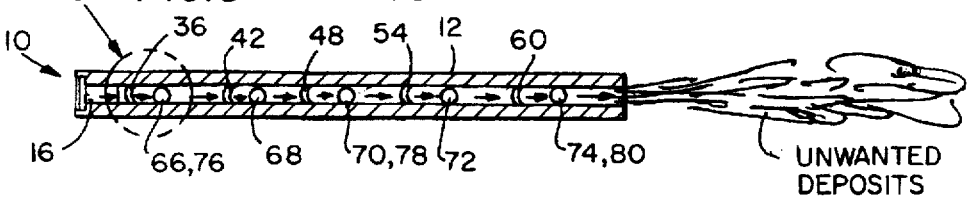
FIG. 5 is a cross sectional view of a typical gun barrel in the process of being cleaned and coated by the exploding present invention.

As shown in FIG. 5, which is a longitudinal cross sectional view of the typical firearm barrel 12, the shell casing internal chamber first internal sub-chamber propellant 64 of the shell casing internal chamber first internal sub-chamber 32 of the shell casing internal chamber 17 in the hollow, cylindrically-shaped, closed back, and open front shell casing 16 has been activated causing the internal components that is contained in the hollow, cylindrically-shaped, closed back, and open front shell casing 16 to exit therefrom.

The shell casing internal chamber sixth internal sub-chamber removable wad 74 of the shell casing internal chamber sixth internal sub-chamber 58 of the shell casing internal chamber 17 in the hollow, cylindrically-shaped, closed back, and open front shell casing 16 that is impregnated with the shell casing internal chamber sixth internal sub-chamber removable wad impregnated cleaning solvent 80 is the first component to exit therefrom and as it moves along the typical firearm barrel 12 it deposits the shell casing internal chamber sixth internal sub-chamber removable wad impregnated cleaning solvent 80 on the interior surface of the typical firearm barrel 12 which dissolves an initial portion of the unwanted deposits on the interior surface of the typical firearm bore 12.

The expandable, generally hemispherically-shaped, rearwardly-facing, and removable fifth wiper 60 is the second component to exit therefrom and expands so as to contact the interior surface of the typical firearm barrel 12 as it moves therealong and wipes off and expels the dissolved initial portion of the unwanted deposits from the interior surface of the typical firearm bore 12.

The shell casing internal chamber fifth internal sub-chamber removable wad 72 of the shell casing internal chamber fifth internal sub-chamber 52 of the shell casing internal chamber 17 in the hollow, cylindrically-shaped, closed back, and open front shell casing 16 that is dry is the third component to exit therefrom and as it moves along the typical firearm barrel 12 it absorbs any remaining portion of the dissolved initial portion of the unwanted deposits on the interior surface of the typical firearm bore 12.

The expandable, generally hemispherically-shaped, rearwardly-facing, and removable fourth wiper 54 is the fourth component to exit therefrom and expands so as to contact the interior surface of the typical firearm barrel 12 as it moves therealong and wipes off and expels any additional remaining portion of the dissolved initial portion of the unwanted deposits from the interior surface of the typical firearm bore 12.

The shell casing internal chamber fourth internal sub-chamber removable wad 70 of the shell casing internal chamber sixth internal sub-chamber 58 of the shell casing internal chamber 17 in the hollow, cylindrically-shaped, closed back, and open front shell casing 16 that is impregnated with the shell casing internal chamber fourth internal sub-chamber removable wad impregnated cleaning solvent 78 is the fifth component to exit therefrom and as it moves along the typical firearm barrel 12 it deposits the shell casing internal chamber fourth internal sub-chamber removable wad impregnated cleaning solvent 78 on the interior surface of the typical firearm barrel 12 which dissolves any remaining portion of the unwanted deposits on the interior surface of the typical firearm bore 12.

The expandable, generally hemispherically-shaped, rearwardly-facing, and removable third wiper 48 is the sixth component to exit therefrom and expands so as to contact the interior surface of the typical firearm barrel 12 as it moves therealong and wipes off and expels the dissolved remaining portion of the unwanted deposits from the interior surface of the typical firearm bore 12.

The shell casing internal chamber third internal sub-chamber removable wad 68 of the shell casing internal chamber third internal sub-chamber 40 of the shell casing internal chamber 17 in the hollow, cylindrically-shaped, closed back, and open front shell casing 16 that is dry is the seventh component to exit therefrom and as it moves along the typical firearm barrel 12 it absorbs any remaining portion of the dissolved remaining portion of the unwanted deposits on the interior surface of the typical firearm bore 12.

The expandable, generally hemispherically-shaped, rearwardly-facing, and removable second wiper 42 is the eighth component to exit therefrom and expands so as to contact the interior surface of the typical firearm barrel 12 as it moves therealong and wipes off and expels any remaining portion of the remaining portion of the dissolved remaining portion of the unwanted deposits on the interior surface of the typical firearm bore 12.

The shell casing internal chamber second internal sub-chamber removable wad 66 of the shell casing internal chamber second internal sub-chamber 34 of the shell casing internal chamber 17 in the hollow, cylindrically-shaped, closed back, and open front shell casing 16 that is impregnated with the shell casing internal chamber second internal sub-chamber removable wad impregnated muzzle flash and barrel erosion reduction composition 76 is the ninth component to exit therefrom and as it moves along the typical firearm barrel 12 it deposits the shell casing internal chamber second internal sub-chamber removable wad impregnated muzzle flash and barrel erosion reduction composition 76 on the interior surface of the typical firearm barrel 12.

Figure 6:
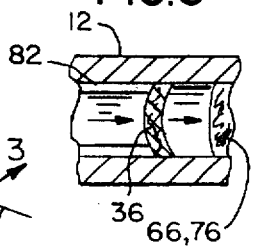
FIG. 6 is an enlarged cross sectional view of the area enclosed by the dotted circle identified by arrow 6 in FIG. 5 illustrating the additive coating deposited on the barrel.

As shown in FIG. 6, which is an enlarged cross sectional view of the area enclosed by the dotted circle identified by arrow 6 in FIG. 5, the expandable, generally hemispherically-shaped, rearwardly-facing, and removable first wiper 36 is the tenth component to exit therefrom and expands so as to contact the interior surface of the typical firearm barrel 12 as it moves therealong and spreads the shell casing internal chamber second internal sub-chamber removable wad impregnated muzzle flash and barrel erosion reduction composition 76 into a smooth flash and barrel erosion reduction composition coating 82 on the interior surface of the typical firearm bore 12.

It will be understood that each of the elements described above, or two or more together, may also find a useful application in other types of constructions differing from the types described above.

While the invention has been illustrated and described as embodied in a firearm barrel cleaning cartridge, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A firearm barrel cleaning cartridge for alternatingly cleaning, wiping, and expelling unwanted debris from an interior surface of a barrel of a typical firearm through a muzzle thereof, comprising:

a) a hollow, cylindrically-shaped, closed back, and open front shell casing that contains an internal chamber defined by a circular-shaped, inwardly flanged, and open front, a circular-shaped and closed back that is displaced behind, and parallel to, said circular-shaped, inwardly flanged, and open front of said hollow, cylindrically-shaped, closed back, and open front shell casing, a cylindrically-shaped longitudinal side extending perpendicularly from said circular-shaped and closed back of said hollow, cylindrically-shaped, closed back, and open front shell casing to said circular-shaped, inwardly flanged, and open front of said hollow, cylindrically-shaped, closed back, and open front shell casing and which has an interior surface and a longitudinal axis;

b) at least one expandable, generally hemispherically-shaped, rearwardly-facing, and removable wiper being contained laterally in said hollow, cylindrically-shaped, closed back, and open front shell casing and dividing said internal chamber in said hollow, cylindrically-shaped, closed back, and open front shell casing into a plurality of internal sub-chambers;

c) a propellant being contained in a first internal sub-chamber of said plurality of internal sub-chambers of said internal chamber in said hollow, cylindrically-shaped, closed back, and open front shell casing adjacent to said circular-shaped and closed back of said hollow, cylindrically-shaped, closed back, and open front shell casing; and d) at least one wad, each wad of said at least one wad being contained in a respective sub-chamber of each at least one remaining sub-chamber of said plurality of internal sub-chambers of said internal chamber in said hollow, cylindrically-shaped, closed back, and open front shell casing, so that when said propellant in said first sub-chamber of said plurality of sub-chambers of said internal chamber in said hollow, cylindrically-shaped, closed back, and open front shell casing is activated each said at least one wad that is contained in said respective sub-chamber of each said at least one remaining sub-chamber of said plurality of internal sub-chambers of said internal chamber in said hollow, cylindrically-shaped, closed back, and open front shell casing exits therefrom alternatingly with each said at least one expandable, generally hemispherically-shaped, rearwardly-facing, and removable wiper that is contained laterally in said hollow, cylindrically-shaped, closed back, and open front shell casing; said at least one expandable, generally hemispherically-shaped, rearwardly-facing, and removable wiper contained laterally in said hollow, cylindrically-shaped, closed back, and open front shell casing being five expandable, generally hemispherically-shaped, rearwardly-facing, and removable wipers so as to divide said plurality of internal sub-chambers of said internal chamber in said hollow, cylindrically-shaped, closed back, and open front shell casing into six internal sub-chambers; said six internal sub-chambers of said internal chamber in said hollow, cylindrically-shaped, closed back, and open front shell casing further includes a second internal sub-chamber disposed adjacent to said first internal sub-chamber of said six internal sub-chambers of said internal chamber in said hollow, cylindrically-shaped, closed back, and open front shell casing and being separated therefrom by a first expandable, generally hemispherically-shaped, rearwardly-facing, and removable wiper of said five expandable, generally hemispherically-shaped, rearwardly-facing, and removable wipers in said hollow, cylindrically-shaped, closed back, and open front shell casing; said six internal sub-chambers of said internal chamber in said hollow, cylindrically-shaped, closed back, and open front shell casing further includes a third internal sub-chamber disposed adjacent to said second internal sub-chamber of said six internal sub-chambers of said internal chamber in said hollow, cylindrically-shaped, closed back, and open front shell casing and being separated therefrom by a second expandable, generally hemispherically-shaped, rearwardly-facing, and removable wiper of said five expandable, generally hemispherically-shaped, rearwardly-facing, and removable wipers in said hollow, cylindrically-shaped, closed back, and open front shell casing; said six internal sub-chambers of said internal chamber in said hollow, cylindrically-shaped, closed back, and open front shell casing further includes a fourth internal sub-chamber disposed adjacent to said third internal sub-chamber of said six internal sub-chambers in said hollow, cylindrically-shaped, closed back, and open front shell casing and being separated therefrom by a third expandable, generally hemispherically-shaped, rearwardly-facing, and removable wiper of said five expandable, generally hemispherically-shaped, rearwardly-facing, and removable wipers in said hollow, cylindrically-shaped, closed back, and open front shell casing; said six internal sub-chambers of said internal chamber in said hollow, cylindrically-shaped, closed back, and open front shell casing further includes a fifth internal sub-chamber disposed adjacent to said fourth internal sub-chamber of said six internal sub-chambers of said internal chamber in said hollow, cylindrically-shaped, closed back, and open front shell casing and being separated therefrom by a fourth expandable, generally hemispherically-shaped, rearwardly-facing, and removable wiper of said five generally hemispherically-shaped, rearwardly-facing, and removable wipers in said hollow, cylindrically-shaped, closed back, and open front shell casing; said six internal sub-chambers of said internal chamber in said hollow, cylindrically-shaped, closed back, and open front shell casing further includes a sixth internal sub-chamber disposed adjacent to said fifth internal sub-chamber of said six internal sub-chambers of said internal chamber in said hollow, cylindrically-shaped, closed back, and open front shell casing and being separated therefrom by a fifth expandable, generally hemispherically-shaped, rearwardly-facing and removable wiper of said five expandable, generally hemispherically-shaped, rearwardly-facing, and removable wipers in said hollow, cylindrically-shaped, closed back, and open front shell casing and being further defined by said circular-shaped, inwardly flanged, and open front of said hollow, cylindrically-shaped, closed back, and open front shell casing; said at least one wad includes a first wad impregnated with a cleaning solvent contained in said sixth internal sub-chamber of said six internal sub-chambers of said internal chamber in said hollow, cylindrically-shaped, closed back, and open front shell casing and which is first to exit from said hollow, cylindrically-shaped, closed back, and open front shell casing when said propellant in said first sub-chamber of said six sub-chambers of said internal chamber in said hollow, cylindrically-shaped, closed back, and open front shell casing is activated, so that said first wad of said at least one wad that is contained in said sixth internal sub-chamber of said six internal sub-chambers of said internal chamber in said hollow, cylindrically-shaped, closed back, and open front shell casing provides a first layer of the cleaning solvent onto the interior surface of the barrel of the typical rifle as said first wad moves therealong which dissolves and expels a portion of the unwanted debris from the interior surface of the barrel of the typical firearm through the muzzle thereof; said fifth expandable, generally hemispherically-shaped, rearwardly-facing, and removable wiper of said five expandable, generally hemispherically-shaped, rearwardly-facing, and removable wipers is second to exit from said hollow, cylindrically-shaped, closed back, and open front shell casing when said propellant in said first sub-chamber of said six sub-chambers of said internal chamber in said hollow, cylindrically-shaped, closed back, and open front shell casing is activated, so that said fifth expandable, generally hemispherically-shaped, rearwardly-facing, and removable wiper of said five expandable, generally hemispherically-shaped, rearwardly-facing, and removable wipers that is contained in said hollow, cylindrically-shaped, closed back, and open front shell casing wipes off and expels another portion of the unwanted debris from the interior surface of the barrel of the typical firearm through the muzzle thereof as said fifth expandable, generally hemispherically-shaped, rearwardly-facing, and removable wiper moves therealong; said at least one wad includes a second wad that is dry and is contained in said fifth internal sub-chamber of said six internal sub-chambers of said internal chamber in said hollow, cylindrically-shaped, closed back, and open front shell casing and which is third to exit from said hollow, cylindrically-shaped, closed back, and open front shell casing when said propellant in said first sub-chamber of said six of sub-chambers of said internal chamber in said hollow, cylindrically-shaped, closed back, and open front shell casing is activated, so that said second wad of said at least one wad that is contained in said fifth internal sub-chamber of said six internal sub-chambers of said internal chamber in said hollow, cylindrically-shaped, closed back, and open front shell casing absorbs and expels another portion of the unwanted debris from the interior surface of the barrel of the typical firearm through the muzzle thereof as said second wad moves therealong; said fourth expandable, generally hemispherically-shaped, rearwardly-facing, and removable wiper of said five expandable, generally hemispherically-shaped, rearwardly-facing, and removable wipers is fourth to exit from said hollow, cylindrically-shaped, closed back, and open front shell casing when said propellant in said first sub-chamber of said six sub-chambers of said internal chamber in said hollow, cylindrically-shaped, closed back, and open front shell casing is activated, so that said fourth expandable, generally hemispherically-shaped, rearwardly-facing, and removable wiper of said five expandable, generally hemispherically-shaped, rearwardly-facing, and removable wipers that is contained in said hollow, cylindrically-shaped, closed back, and open front shell casing wipes off and expels another portion of the unwanted debris from the interior surface of the barrel of the typical firearm through the muzzle thereof as said fourth expandable, generally hemispherically-shaped, rearwardly-facing, and removable wiper moves therealong; said at least one wad includes a third wad impregnated with the cleaning solvent that is contained in said fourth internal sub-chamber of said six internal sub-chambers of said internal chamber in said hollow, cylindrically-shaped, closed back, and open front shell casing and which is fifth to exit from said hollow, cylindrically-shaped, closed back, and open front shell casing when said propellant in said first sub-chamber of said six sub-chambers of said internal chamber in said hollow, cylindrically-shaped, closed back, and open front shell casing is activated, so that said third wad of said at least one wad that is contained in said fourth internal sub-chamber of said six internal sub-chambers of said internal chamber in said hollow, cylindrically-shaped, closed back, and open front shell casing provides a second layer of the cleaning solvent on the interior surface of the barrel of the typical rifle as said third wad moves therealong which dissolves and expels another portion of the unwanted debris from the interior surface of the barrel of the typical firearm through the muzzle thereof; said third expandable, generally hemispherically-shaped, rearwardly-facing, and removable wiper of said five expandable, generally hemispherically-shaped, rearwardly-facing, and removable wipers is sixth to exit from said hollow, cylindrically-shaped, closed back, and open front shell casing when said propellant in said first sub-chamber of said six sub-chambers of said internal chamber in said hollow, cylindrically-shaped, closed back, and open front shell casing is activated, so that said third expandable, generally hemispherically-shaped, rearwardly-facing, and removable wiper of said five expandable, generally hemispherically-shared, rearwardly-facing, and removable wipers that is contained in said hollow, cylindrically-shaped, closed back, and open front shell casing wipes off and expels another portion of the unwanted debris from the interior surface of the barrel of the typical firearm through the muzzle thereof as said third expandable, generally hemispherically-shaped, rearwardly-facing, and removable wiper moves therealong; said at least one wad includes a fourth wad that is dry and is contained in said third internal sub-chamber of said six internal sub-chambers of said internal chamber in said hollow, cylindrically-shaped, closed back, and open front shell casing and is seventh to exit from said hollow, cylindrically-shaped, closed back, and open front shell casing when said propellant in said first sub-chamber of said six internal sub-chambers of said internal chamber in said hollow, cylindrically-shaped, closed back, and open front shell casing is activated, so that said fourth wad of said at least one wad that is contained in said third internal sub-chamber of said six internal sub-chambers of said internal chamber in said hollow, cylindrically-shaped, closed back, and open front shell casing absorbs and expels another portion of the unwanted debris from the interior surface of the barrel of the typical firearm through the muzzle thereof as said fourth wad moves therealong; said second expandable, generally hemispherically-shaped, rearwardly-facing, and removable wiper of said five expandable, generally hemispherically-shaped, rearwardly-facing, and removable wipers is eighth to exit from said hollow, cylindrically-shaped, closed back, and open front shell casing when said propellant in said first sub-chamber of said six sub-chambers of said internal chamber in said hollow, cylindrically-shaped, closed back, and open front shell casing is activated, so that said second expandable, generally hemispherically-shaped, rearwardly-facing, and removable wiper of said five expandable, generally hemispherically-shaped, rearwardly-facing, and removable wipers that is contained in said hollow, cylindrically-shaped, closed back, and open front shell casing wipes off and expels another portion of the unwanted debris from the interior surface of the barrel of the typical firearm through the muzzle thereof as said second expandable, generally hemispherically-shaped, rearwardly-facing, and removable wiper moves therealong; said at least one wad includes a fifth wad impregnated with a muzzle flash and barrel erosion reduction composition that is contained in said second internal sub-chamber of said six internal sub-chambers of said internal chamber in said hollow, cylindrically-shaped, closed back, and open front shell casing and which is ninth to exit from said hollow, cylindrically-shaped, closed back, and open front shell casing when said propellant in said first sub-chamber of said six sub-chambers of said internal chamber in said hollow, cylindrically-shaped, closed back, and open front shell casing is activated, so that said fifth wad of said at least one wad that is contained in said second internal sub-chamber of said six internal sub-chambers of said internal chamber in said hollow, cylindrically-shaped, closed back, and open front shell casing provides a layer of said muzzle flash and barrel erosion reduction composition on the interior surface of the barrel of the typical firearm as said fifth wad moves therealong; said first expandable, generally hemispherically-shaped, rearwardly-facing, and removable wiper of said five expandable, generally hemispherically-shaped, rearwardly-facing, and removable wipers is tenth to exit from said hollow, cylindrically-shaped, closed back, and open front shell casing when said propellant in said first sub-chamber of said six sub-chambers of said internal chamber in said hollow, cylindrically-shaped, closed back, and open front shell casing is activated, so that said first expandable, generally hemispherically-shaped, rearwardly-facing, and removable wiper of said five expandable, generally hemispherically-shaped, rearwardly-facing, and removable wipers that is contained in said hollow, cylindrically-shaped, closed back, and open front shell casing smooths out said layer of said muzzle flash and barrel erosion reduction composition on the interior surface of the barrel of the typical firearm as said first expandable, generally hemispherically-shaped, rearwardly-facing, and removable wiper moves therealong and provides a smooth coating thereon; said muzzle flash and barrel erosion reduction composition being an aqueous solution of a material selected from the group consisting of $Na_2O_xSiO_2$, $K_2O_xSiO_2$, and combinations thereof, wherein x is 3–5, and which can be impregnated at ambient temperature and at atmospheric pressure, and wherein $SiO_2$ acts as an erosion reducer; said material being about 5%–20% by weight and being a loose dry powder; said muzzle flash and barrel erosion reduction composition further containing small quantities of an additional material selected from the group consisting of talc, $TiO_2$, and combinations thereof; said muzzle flash and barrel erosion reduction composition further containing a flash suppressant selected from the group consisting of volatile and non-volatile; said volatile flash suppressant being selected from the group consisting of $NH_4HCO_3$, $(NH_4)_2CO_3$, and $KHCO_3$; said flash suppressant being about 3%–6% by weight.

2. The cartridge as defined in claim 1, wherein said circular-shaped and closed back of said hollow, cylindrically-shaped, closed back, and open front shell casing is metallic.

3. The cartridge as defined in claim 1, wherein said cylindrically-shaped longitudinal side of said hollow, cylindrically-shaped, closed back, and open front shell casing is a material selected from the group consisting of fiber board, cellulosic fibers, nitrocellulose, and combinations thereof.

4. The cartridge as defined in claim 1, wherein said circular-shaped and closed back of said hollow, cylindrically-shaped, closed back, and open front shell casing extends radially outwardly from, and circumferentially around, said cylindrically-shaped longitudinal side of said hollow, cylindrically-shaped, closed back, and open front shell casing so as to form a radially-outwardly-extending and circumferentially-disposed circumferential rim therearound.

5. The cartridge as defined in claim 1, wherein each wad of said at least one wad that is contained in said respective sub-chamber of each said at least one remaining sub-chamber of said plurality of internal sub-chambers of said internal chamber in said hollow, cylindrically-shaped, closed back, and open front shell casing is a material selected from the group consisting of fiber, cotton, jute, and combinations thereof.

6. The cartridge as defined in claim 1, wherein said circular-shaped and closed back of said hollow, cylindrically-shaped, closed back, and open front shell casing has a centrally-disposed and inwardly-longitudinally-extending primer cap that extends inwardly therefrom into said internal chamber in said hollow, cylindrically-shaped, closed back, and open front shell casing along said longitudinal axis of said hollow, cylindrically-shaped, closed back, and open front shell casing.

7. The cartridge as defined in claim 1, wherein said circular-shaped, inwardly flanged, and open front of said hollow, cylindrically-shaped, closed back, and open front shell casing is removably closed by a removably mounted and laterally-oriented disk that abuts against said inward flange of said circular-shaped, inwardly flanged, and open front of said hollow, cylindrically-shaped, closed back, and open front shell casing and which is parallel to said circular-shaped and closed back of said hollow, cylindrically-shaped, closed back, and open front shell casing.

8. The cartridge as defined in claim 7, wherein said removably mounted and laterally-oriented disk is a material selected from the group consisting of fiber board, cellulosic fibers, nitrocellulose, and combinations thereof.

9. A method of using a firearm barrel cleaning cartridge to clean and coat an interior surface of a barrel of a typical firearm with a muzzle flash and erosion reduction compound, comprising the steps of:

a) inserting said firearm barrel cleaning cartridge into the barrel of the typical firearm whose interior surface is to be cleaned and coated;

b) activating a propellant that is contained in a first internal sub-chamber of an internal chamber in a hollow, cylindrically-shaped, closed back, and open front shell casing of said firearm barrel cleaning cartridge;

c) expelling a first removable wad that is impregnated with a cleaning solvent from a second internal sub-chamber of said internal chamber in said hollow, cylindrically-shaped, closed back, and open front shell casing;

d) depositing the cleaning solvent on the interior surface of the barrel of the typical firearm as said first removable wad moves therealong;

e) dissolving and expelling a portion of the unwanted deposits from the interior surface of the barrel of the typical firearm through the muzzle thereof as said first removable wad moves therealong;

f) expelling a first expandable, generally hemispherically-shaped, rearwardly-facing, and removable wiper from said hollow, cylindrically-shaped, closed back, and open front shell casing;

g) expanding said first expandable, generally hemispherically-shaped, rearwardly-facing, and removable wiper so as to contact the interior surface of the barrel of the typical firearm as said first expandable, generally hemispherically-shaped, rearwardly-facing, and removable wiper moves therealong;

h) wiping off and expelling another portion of the unwanted deposits from the interior surface of the barrel of the typical firearm through the muzzle thereof as said first expandable, generally hemispherically-shaped, rearwardly-facing, and removable wiper moves therealong;

i) expelling a second removable wad that is dry from a third internal sub-chamber of said internal chamber in said hollow, cylindrically-shaped, closed back, and open front shell casing;

j) absorbing and expelling another portion of the unwanted deposits from the interior surface of the barrel of the typical firearm through the muzzle thereof as said second removable wad moves therealong;

k) expelling a second expandable, generally hemispherically-shaped, rearwardly-facing, and removable wiper from said hollow, cylindrically-shaped, closed back, and open front shell casing;

l) expanding said second expandable, generally hemispherically-shaped, rearwardly-facing, and removable wiper so as to contact the interior surface of the barrel of the typical firearm as said second expandable, generally hemispherically-shaped, rearwardly-facing, and removable wiper moves therealong;

m) wiping off and expelling another portion of the unwanted deposits from the interior surface of the barrel of the typical firearm through the muzzle thereof as said second expandable, generally hemispherically-shaped, rearwardly-facing, and removable wiper moves therealong;

n) expelling a third removable wad that is impregnated with the cleaning solvent from a fourth internal sub-chamber of said internal chamber in said hollow, cylindrically-shaped, closed back, and open front shell casing;

o) depositing the cleaning solvent on the interior surface of the barrel of the typical firearm as said third removable wad moves therealong;

p) dissolving and expelling another portion of the unwanted deposits from the interior surface of the barrel of the typical firearm through the muzzle thereof as said third removable wad moves therealong;

q) expelling a third expandable, generally hemispherically-shaped, rearwardly-facing, and removable wiper from said hollow, cylindrically-shaped, closed back, and open front shell casing;

r) expanding said third expandable, generally hemispherically-shaped, rearwardly-facing, and removable wiper so as to contact the interior surface of the barrel of the typical firearm as said third expandable, generally hemispherically-shaped, rearwardly-facing, and removable wiper moves therealong;

s) wiping off and expelling another portion of the unwanted deposits from the interior surface of the barrel of the typical firearm through the muzzle thereof as said third expandable, generally hemispherically-shaped, rearwardly-facing, and removable wiper moves therealong;

t) expelling a fourth removable wad that is dry from a fifth internal sub-chamber of said internal chamber in said hollow, cylindrically-shaped, closed back, and open front shell casing;

u) absorbing and expelling another portion of the unwanted deposits from the interior surface of the barrel of the typical firearm through the muzzle thereof as said fourth removable wad moves therealong;

v) expelling a fourth expandable, generally hemispherically-shaped, rearwardly-facing, and removable wiper from said hollow, cylindrically-shaped, closed back, and open front shell casing;

w) expanding said fourth expandable, generally hemispherically-shaped, rearwardly-facing, and removable wiper so as to contact the interior surface of the barrel of the typical firearm as said fourth expandable, generally hemispherically-shaped, rearwardly-facing, and removable wiper moves therealong;

x) wiping off and expelling another portion of the unwanted deposits from the interior surface of the barrel of the typical firearm through the muzzle thereof as said fourth expandable, generally hemispherically-shaped, rearwardly-facing, and removable wiper moves therealong;

y) expelling a fifth removable wad that is impregnated with a muzzle flash and barrel erosion reduction composition from a sixth internal sub-chamber of said internal chamber in said hollow, cylindrically-shaped, closed back, and open front shell casing; p1 z) depositing said muzzle flash and barrel erosion reduction composition on the interior surface of the barrel of the typical firearm as said fifth removable wad moves therealong;

aa) expelling a fifth expandable, generally hemispherically-shaped, rearwardly-facing, and removable wiper from said hollow, cylindrically-shaped, closed back, and open front shell casing;

bb) expanding said fifth expandable, generally hemispherically-shaped, rearwardly-facing, and removable wiper so as to contact the interior surface of the barrel of the typical firearm as said fifth expandable, generally hemispherically-shaped, rearwardly-facing, and removable wiper moves therealong; and cc) smoothing out said muzzle flash and barrel erosion reduction composition on the interior surface of the barrel of the typical firearm as said fifth expandable, generally hemispherically-shaped, rearwardly-facing, and removable wiper moves therealong so as to form a smooth coating thereon.

* * * * *